US006100021A

United States Patent [19]

Fabricius et al.

[11] Patent Number: 6,100,021

[45] Date of Patent: Aug. 8, 2000

[54] SENSITIZATION OF SILVER HALIDE

[75] Inventors: Dietrich Max Fabricius, Hendersonville; Allan R. Schoenberg, Asheville, both of N.C.

[73] Assignee: Agfa-Gevaert N.V., Mortsel, Belgium

[21] Appl. No.: 09/212,070

[22] Filed: Dec. 15, 1998

[51] Int. Cl.[7] ..... G03C 1/09

[52] U.S. Cl. ..... 430/603; 430/567; 430/569

[58] Field of Search ..... 430/603, 567, 430/569

[56] References Cited

U.S. PATENT DOCUMENTS

| | | | |
|---|---|---|---|
| 3,232,764 | 2/1966 | Allen et al. | 430/603 |
| 3,297,446 | 1/1967 | Dunn | 96/107 |
| 3,442,653 | 5/1969 | Dunn | 96/108 |
| 4,861,703 | 8/1989 | Lok | 430/608 |
| 5,236,821 | 8/1993 | Yagihara | 430/600 |
| 5,240,827 | 8/1993 | Lewis | 430/603 |
| 5,320,938 | 6/1994 | House | 430/567 |
| 5,391,475 | 2/1995 | Nishigaki | 430/600 |
| 5,468,602 | 11/1995 | Takahashi | 430/569 |
| 5,807,662 | 9/1998 | Takahashi | 430/603 |

*Primary Examiner*—Janet Baxter
*Assistant Examiner*—Amanda C. Walke
*Attorney, Agent, or Firm*—Joseph T. Guy, Jr.

[57] ABSTRACT

Provided is an improved sensitization method for photographic element. The photographic element comprises a support with at least one hydrophilic colloid layer coated thereon. The hydrophilic colloid layer comprises silver halide grains which are chemically sensitized with at least one compound represented by Formula 1:

$$(OCH)_2R^1(LHSO_3)_2 \qquad \text{Formula 1}$$

and at least one selenium compound.

In formula 1, $R^1$ represents an alkyl of 1–8 carbons; and L represents and alkali metal. The selenium compound is chosen from a group consisting of $R^2SeCN$, $(R^3)_3PSe$ and $((R^4)_2NCO)_2Se$ wherein $R^2$ represents an alkyl of 1 to 8 carbons, or an alkali metal atom; $R^3$ independently represents an aryl of 6 to 10 carbons or an alkyl of 1 to 8 carbons; and $R^4$ independently represents an aryl of 6 to 10 carbons or an alkyl of 1 to 8 carbons.

5 Claims, No Drawings

SENSITIZATION OF SILVER HALIDE

FIELD OF INVENTION

The present invention is related to an improved chemical sensitization for silver halide. More specifically, the present invention is related to an improved chemical sensitization of silver halide by the combination of glutaraldehyde bisulfite and specific selenium compounds.

BACKGROUND OF THE INVENTION

Silver halide photographic emulsions are well known in the art. It is known in the art that silver halide emulsions can be chemically sensitized to increase the photographic response to actinic radiation.

Selenium compounds have been known as potential sensitizers as exemplified in many patents including U.S. Pat. Nos. 5,236,821; 5,468,602; 5,391,475; 5,547,830. Controlling fog in selenium sensitized emulsions is a particular problem which is improved in the teachings of the present invention.

SUMMARY OF THE INVENTION

It is an object of the present invention to provide an improved sensitization of silver halide grains utilizing specific selenium compounds in combination with specific aldehydes.

A particular feature of the present invention is an increase in photographic speed without compromising fog growth.

A particularly advantageous feature is the superior aging properties observed as indicated by minimal fog build over time.

These and other features are provided in a photographic element comprising a support with at least one hydrophilic colloid layer coated thereon. The hydrophilic colloid layer comprises silver halide grains which are chemically sensitized with at least one compound represented by Formula 1:

$$(OCH)_2R^1(LHSO_3)_2 \qquad \text{Formula 1}$$

and at least one selenium compound.

In formula 1, $R^1$ represents an alkyl of 1–8 carbons; and L represents and alkali metal. The selenium compound is chosen from a group consisting of $R^2SeCN$, $(R^3)_3PSe$ and $((R^4)_2NCO)_2Se$ wherein $R^2$ represents an alkyl of 1 to 8 carbons, or an alkali metal atom; $R^3$ independently represents an aryl of 6 to 10 carbons or an alkyl of 1 to 8 carbons; and $R^4$ independently represents an aryl of 6 to 10 carbons or an alkyl of 1 to 8 carbons.

DETAILED DESCRIPTION OF THE INVENTION

The selenium compound of the present invention is exemplified by the chemical compositions defined by Formulas 1, 2 and 3.

$$R^2SeCN \qquad \text{Formula 1}$$

$$(R^3)_3PSe \qquad \text{Formula 2}$$

$$((R^4)_2NCO)_2Se \qquad \text{Formula 3}$$

In Formula 1, $R^2$ represents an alkyl of 1 to 8 carbons, or an alkali metal atom.

In Formula 2, each $R^3$ independently represents an aryl of 6 to 10 carbons or an alkyl of 1 to 8 carbons.

In Formula 3, each $R^4$ independently represents an aryl of 6 to 10 carbons or an alkyl of 1 to 8 carbons.

Particularly preferred selenium compounds are exemplified by:

SI-1

KSeCN

SI-2

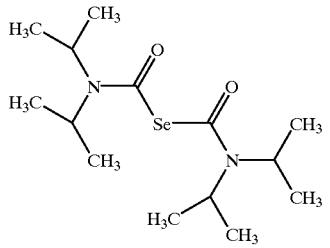

SI-3

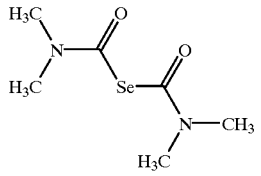

SI-4

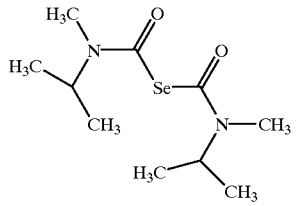

SI-5

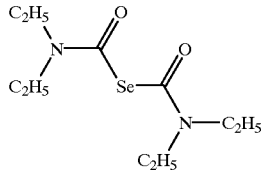

SI-6

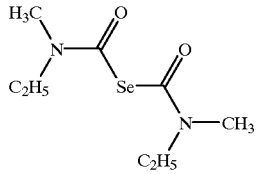

SI-7

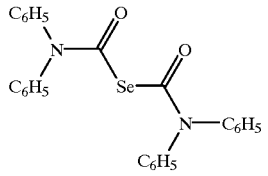

-continued

SI-8

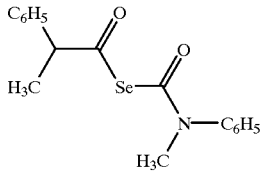

and

SI-9

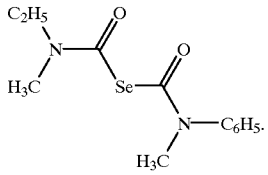

The glutaraldehyde bisulfite composition is exemplified by Formula 4.

$$(OCH)_2R^5(LHSO_3)_2 \qquad \text{Formula 4}$$

In Formula 4, $R^5$ represents an alkyl of 1–8 carbons. More preferably $R^5$ represents and alkyl of 1–3 carbons. Most preferably, $R^5$ represents and alkyl of 3 carbons. L represents an alkali metal preferably chosen from the group consisting of Na and K. The glutaraldehyde bisulfite compositions described are readily available from commercial sources.

The terms "alkyl", "aryl", and "aralkyl" and other groups refer to both unsubstituted and substituted groups unless specified to the contrary. Alkyl can be saturated, unsaturated, straight chain or branched and unless otherwise specified refers to alkyls of 1 to 24 carbon atoms. Unless otherwise specified the term aryl refers to aryls of 6 to 24 carbons. Preferred substituents include but are not limited to halogen; nitro; carboxyl in the form of a salt or carboxylic acid; hydroxyl; alkoxy; amine; thiol; amide; vinyl; sulfate; cyano; alkylammonium, carbonyl and thioether.

The sensitizers of the present invention are preferably added to a silver halide photographic emulsion as an aqueous dispersion or solution. The most preferred time of addition is after grain preparation and prior to spectral sensitization although this may very without departing from the spirit of the invention. The amount of selenium compound added is preferably 0.06 to 4.0 mg of selenium compound per mole of silver and more preferably from 0.2 to 2.4 mg of selenium compound per mole of silver. The amount of glutaraldehyde bisulfite compound added is preferably 0.1 to 1.0 grams of glutaraldahyde bisulfite per mole of silver and preferably from 0.2 to 0.6 grams of glutaraldahyde per mole of silver.

Any of the conventional halides may be used but preferred is pure silver bromide or silver bromide with up to 5% iodide, by weight, incorporated therein. A silver halide grain with 98% Br and 2% I, by weight, is suitable for demonstration of the utility of the present invention. Any grain morphology is suitable for demonstration of these teachings including, but not limited to, grains which are formed by splash techniques and those formed by spray techniques. Tabular grains are most preferred.

The grains are preferably dispersed in a binder (e.g. gelatin or other well-known binders such as polyvinyl alcohol, phthalated gelatins, etc.). In place of gelatin other natural or synthetic water-permeable organic colloid binding agents known in the art can be used as a total or partial replacement thereof. It is common to use binder adjuvants useful for increasing covering power such as dextran or the modified, hydrolyzed gelatins of Rakoczy, U.S. Pat. No. 3,778,278.

Additional chemical sensitization of the grain with salts that are well known in the art may be beneficial. The most common sensitizers are salts of gold or sulfur. Sulfur sensitizers include those which contain labile sulfur, e.g. allyl isothiocyanate, allyl diethyl thiourea, phenyl isothiocyanate and sodium thiosulfate for example. The polyoxyalkylene ethers in Blake et al., U.S. Pat. No. 2,400,532, and the polyglycols disclosed in Blake et al., U.S. Pat. No. 2,423,549. Other non-optical sensitizers such as amines as taught by Staud et al., U.S. Pat. No. 1,925,508 and Chambers et al., U.S. Pat. No. 3,026,203, and metal salts as taught by Baldsiefen, U.S. Pat. No. 2,540,086 may also be used. Spectral sensitizing dyes may be used. These methods are well known in the art and include, but are not limited to, cyanines, merocyanines, oxonols, hemioxonols, styryls, merostyryls, complex cyanines and merocyanines (i.e. tri-, tetra-, and polynuclear cyanines and merocyanines), and streptocyanines as illustrated in *Research Disclosure*, No 308, December, 1989, Item 308119.

The emulsions can contain known antifoggants, e.g. 6-nitrobenzimidazole, benzotriazole, triazaindenes, etc., as well as the usual hardeners, i.e., chrome alum, formaldehyde, dimethylol urea, mucochloric acid, imidazolium compounds, pyridinium compounds, etc. Other emulsion adjuvants that may be added comprise matting agents, plasticizers, toners, optical brightening agents, surfactants, image color modifiers, non-halation dyes, and covering power adjuvants among others.

The film support for the emulsion layers used in the novel process may be any suitable transparent plastic. For example, the cellulosic supports, e.g. cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. When polyethylene terephthalate is manufactured for use as a photographic support, it is preferable to use a mixed polymer subbing composition such as that taught by Rawlins, U.S. Pat. No. 3,567,452, Miller, U.S. Pat. Nos. 4,916,011 and 4,701,403, Cho, U.S. Pat. Nos. 4,891,308 and 4,585,730 and Schadt, U.S. Pat. No. 4,225,665. Upon completion of stretching and application of subbing composition, it is necessary to remove strain and tension in the base by a heat treatment comparable to the annealing of glass.

The emulsions may be coated on the supports mentioned above as a single layer or multi-layer element. For medical x-ray applications, for example, layers may be coated on both sides of the support which conventionally contains a dye to impart a blue tint thereto. Contiguous to the emulsion layers it is conventional, and preferable, to apply a thin stratum of hardened gelatin supra to said emulsion to provide protection thereto.

The emulsions of this invention can be used in any of the conventional photographic systems (e.g. negative or positive-working systems). Thus, they can contain any of the adjuvants related to the particular system employed. For example, the emulsions when employed as direct positive may be chemically fogged using metals such as rhodium or iridium and the like, or with other chemical fogging agents such as boranes, as well-known to those skilled in the art.

It is conventional to use the photographic emulsions of this invention with X-ray intensifying screens. These are usually used in pairs in cooperation with double-side coated medical X-ray silver halide photographic film elements, although it is sometimes common to use single-side coated silver halide photographic film elements for some applications. A pair of screens is conventionally used and the coating weights of each screen may be different, if required. Thus, an asymmetric pair of screens can be used to get the best results. Medical X-ray evaluations represent a commercial use for the photographic element comprising the inventive sensitization.

Although any conventional silver halide photographic system can be employed to demonstrate the teachings of this invention a medical radiographic system will be used as an illustrative example.

PREPARATION OF SELENIUM COMPOUNDS

The syntheses of selenocarbamates is based on the method of Kato, et al., Heteroatom Chem., 6(3), 215–221 (1995)

Preparation of tetra(isopropyl)selenodicarbonic diamide(SI-2)

Sodium selenide (1.35 g, 10.8 mmol) was slurried in 10 ml acetonitrile to give a magenta mixture.

Diisopropylcarbamyl chloride ( 3.52 g, 21.6 mmol) was dissolved in 20 ml hot acetonitrile. The diisopropylcarbamyl chloride crystallized upon cooling and was added as a slurry to the sodium selenide slurry. The mixture exothermed to 36–38° C., precipitated black selenium particles, and underwent color changes from brown to white to green and finally to tan. The mixture was stirred 4 hrs and filtered to remove precipitated selenium and sodium chloride from the product-containing yellow filtrate. The filtrate was rotary evaporated to yield 2.74 g of orange product, mp 79–100° C. The product was recrystallized from isopropanol-water to give crystals with mp 90.5–91° C. and 128° C.

Preparation of tetramethylselenodicarbonic diamide(SI-3)

Sodium selenide (1.25 g, 10 mmol) was slurried in 15 ml acetonitrile to give a magenta mixture. Dimethylcarbamyl chloride (2 ml, ~20 mmol) was added. The mixture immediately browned, then reverted to magenta color and then gradually grayed with precipitation of sodium chloride. After 2.5 hrs, the black-gray mixture was filtered to remove selenium and sodium chloride. The recovered colorless filtrate was rotary evaporated to 2.22 g of yellow oil, which crystallized to white needles, mp 63–71° C.

The crystals were washed with ethyl ether to yield material melting at 76–81° C.

PREPARATION OF PHOTOGRAPHIC EMULSION

EXAMPLE 1

A silver bromide tabular grain emulsion was prepared according to the teachings of Ellis, U.S. Pat. No. 4,801,522. After precipitation of the grains the average aspect ratio was determined to be about 5:1 and thickness of about 0.21 $\mu$m. These grains were dispersed in photographic gelatin at about 117 grams gelatin/mole of silver bromide. A solution of Dye A in methanol with tributylamine was added to achieve approximately 336 mg of dye per mole of silver halide. At this point, the emulsion was brought to its optimum sensitivity with gold and sulfur salts as is well-known to those skilled in the art. The emulsion was stabilized by the addition of 4-hydroxy-6-methyl-1,3,3a,7-tetraaza-indene and 1-phenyl-5-mercaptotetrazole. The usual wetting agents, antifoggants, coating aids, and hardeners were added and this emulsion was then coated on a dimensionally stable, 7 mil polyethylene terephthalate film support which had first been coated with a conventional resin sub followed by a thin substratum of hardened gelatin applied supra thereto. These subbing layers were present on both sides of the support. The emulsion was coated on one side at about 2 gm silver per square meter. A thin abrasion layer of hardened gelatin was applied over the emulsion layer. Samples of each of these coatings were given an X-ray exposure with a Cronex® Quanta Rapid x-ray intensifying screen which is commercially available from Sterling Diagnostic Imaging, Inc. of Greenville, S.C. or an equivalent exposure with a standard exposure device. A conventional step wedge test target was used as common in the art. The film was then developed in a conventional X-ray film processor. In all of the examples Rel. Speed is reported based on a control with the speed of Sample 1 being set to an arbitrary speed of 100. Fog is reported as photographic fog plus the contribution from the support. In all cases the support was identical which allows for direct comparison of photographic fog. The results are summarized in the Table 1.

Dye A

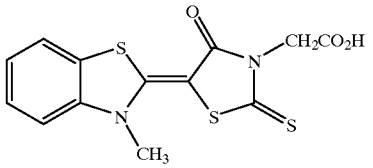

TABLE 1

| Sample | GDA | Sel | B + F | Spd |
|---|---|---|---|---|
| 1 | 0 | 0 | 0.18 | 100 |
| 2 | 0.27 | 0 | 0.17 | 112 |
| 3 | 0.53 | 0 | 0.17 | 156 |
| 4 | 0.80 | 0 | 0.17 | 179 |
| 5 | 0 | 0.27 | 0.17 | 137 |
| 6 | 0 | 0.53 | 0.20 | 154 |
| 7 | 0 | 0.8 | 0.46 | 118 |
| 8 | 0.27 | 0.27 | 0.17 | 179 |
| 9 | 0.27 | 0.53 | 0.23 | 197 |
| 10 | 0.53 | 0.27 | 0.17 | 196 |
| 11 | 0.53 | 0.53 | 0.29 | 221 |

GDA is the grams of glutaraldehyde bisulfite of formula $(OCH_2)_2C_3H_6(NaHSO_3)_2$ per mole of silver halide.
SeL is the mg of selenium compound SI-1 per mole of silver halide.
B + F is the sum of photographic fog plus density of the support.
Spd is the relative speed.

Example 1 illustrates that glutaraldehyde bisulfite and a selenium compound each independently provide an increase in sensitization. The combination provides an additional increase in sensitization due to synergistic reactivity.

EXAMPLE 2

Emulsions were prepared similarly to example 1 and tested fresh coating and upon 14-month aging under normal room temperature and humidity. Test results are summarize in Table II

TABLE II

| GDA | KSeCN | Fresh | | 14-month | |
|---|---|---|---|---|---|
| (g/mol) | (mg/mol) | B + F | Spd | B + F | Spd |
| 0 | 0 | 0.16 | 100 | 0.17 | 100 |
| 0.2 | 0 | 0.16 | 108 | 0.18 | 119 |
| 0.4 | 0 | 0.17 | 126 | 0.18 | 133 |

TABLE II-continued

| GDA | KSeCN | Fresh | | 14-month | |
|---|---|---|---|---|---|
| (g/mol) | (mg/mol) | B + F | Spd | B + F | Spd |
| 0 | 0.2 | 0.16 | 125 | 0.17 | 145 |
| 0 | 0.4 | 0.18 | 128 | 0.21 | 194 |
| 0 | 0.6 | 0.2 | 143 | 0.22 | 194 |
| 0.2 | 0.2 | 0.17 | 144 | 0.19 | 170 |
| 0.4 | 0.2 | 0.17 | 145 | 0.19 | 168 |

Example 2 illustrates that the use of the combination of glutaraldehyde bisulfite with a selenium compound provides sensitization benefit even after extended normal aging with minimal adverse effect on B+F.

EXAMPLE 3

Emulsion was prepared as in Example 1 except the selenium compound was triphenylphosphine selenide (TPPSe).

TABLE III

| GDA | TPPSE | Fresh | | 15-month aging | |
|---|---|---|---|---|---|
| (g/mol) | (mg/mol) | B + F | Spd | B + F | Spd |
| 0 | 0 | 0.19 | 100 | 0.21 | 100 |
| 0.2 | 0 | 0.20 | 123 | 0.22 | 129 |
| 0.4 | 0 | 0.17 | 145 | 0.20 | 155 |
| 0 | 0.8 | 0.17 | 150 | 0.18 | 168 |
| 0 | 1.6 | 0.19 | 162 | 0.20 | 210 |
| 0 | 2.4 | 0.25 | 176 | 0.27 | 216 |
| 0.2 | 0.8 | 0.17 | 177 | 0.20 | 203 |
| 0.4 | 0.8 | 0.17 | 193 | 0.21 | 214 |

Example 3 illustrates that good B+F and sensitization performance with the combination of glutaraldehyde bisulfite and triphenylphosphine selenide after fresh testing and after long term storage under normal room temperature and humidity.

We claim:

1. A photographic element comprising a support with at least one hydrophilic colloid layer coated thereon;

said hydrophilic colloid layer comprises silver halide grains which are chemically sensitized with at least one compound represented by the formula:

$$(OCH)_2R^5(LHSO_3)_2 \qquad \text{Formula 4}$$

wherein:

$R^1$ represents an alkyl of 1–8 carbons; and

L represents an alkali metal; and a selenium compound represented by the formula $$((R^4)_2NCO)_2Se \qquad \text{Formula 3}$$

wherein $R^4$ independently represents an aryl of 6 to 10 carbons or an alkyl of 1 to 8 carbons.

2. The photographic element of claim 1 wherein said $R^4$ is chosen from a group consisting of methyl, ethyl, isopropyl, phenyl and methylphenyl.

3. The photographic element of claim 2 wherein said $R^4$ is chosen from a group consisting of methyl, ethyl, and isopropyl.

4. The photographic element of claim 1 wherein said selenium compound is

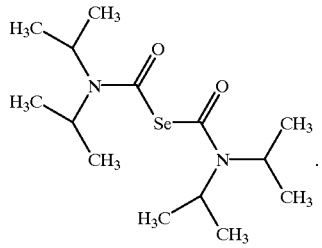

5. The photographic element of claim 1 wherein said selenium compound is

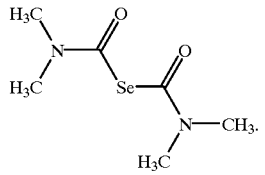

* * * * *